US008066018B2

(12) United States Patent
Hsu

(10) Patent No.: US 8,066,018 B2
(45) Date of Patent: Nov. 29, 2011

(54) HAIR CLIP WITHOUT COIL SPRING

(76) Inventor: Shih Ling Hsu, Tainan (TW)

( * ) Notice: Subject to any disclaimer, the term of this patent is extended or adjusted under 35 U.S.C. 154(b) by 450 days.

(21) Appl. No.: 12/316,139

(22) Filed: Dec. 10, 2008

(65) Prior Publication Data

US 2010/0139687 A1 Jun. 10, 2010

(51) Int. Cl.
*A45D 8/20* (2006.01)
*A45D 8/00* (2006.01)

(52) U.S. Cl. ..... 132/277; 132/276

(58) Field of Classification Search ..... 132/277, 132/255, 276, 278, 279, 223; 24/455; D28/40
See application file for complete search history.

(56) References Cited

U.S. PATENT DOCUMENTS 2,601,858 A 7/1952 Ackerman
2,798,499 A * 7/1957 Reiner ..... 132/277
5,697,388 A * 12/1997 Chang ..... 132/277
5,988,184 A 11/1999 Shu ..... 132/277
6,035,863 A * 3/2000 Mao ..... 132/273
2008/0149129 A1* 6/2008 Yang ..... 132/277

* cited by examiner

*Primary Examiner* — Robyn Doan

(74) *Attorney, Agent, or Firm* — Charles E. Baxley

(57) ABSTRACT

A hair clip includes two jaws each having a hand grip extended from one end and a connector disposed on a middle portion, and a coupling device having a spring member engaged with the connectors of the jaws for coupling the jaws and the coupling device together and for applying a spring biasing force to bias and force the lugs and one ends of the jaws toward each other, and for allowing the jaws to be forced away from each other and to engage with a hair of a user when the hand grips are forced and depressed toward each other by the user. The jaws each include an opening for anchoring the spring member to the jaws. An elastic member may resiliently couple the lugs of the spring member together.

9 Claims, 6 Drawing Sheets

HAIR CLIP WITHOUT COIL SPRING

BACKGROUND OF THE INVENTION

1. Field of the Invention

The present invention relates to a hair clip, and more particularly to a hair clip including two spring-biased jaws resiliently coupled together with a resilient-coupling device without a torsional spring or a coil spring or fasteners for preventing the hair of the user from being entangled by the jaws and the torsional spring or the coil spring and/or the fasteners.

2. Description of the Prior Art

Typical hair clips or hair styling devices comprise a horizontal base or lower member and an upper resilient member or two rings pivotally connected together, and a coil spring is required to be provided and engaged between the two rings or clip members for biasing the rings toward each other and for clasping or holding the hair or for styling the hair of the user.

For example, U.S. Pat. No. 2,601,858 to Ackerman discloses one of the typical hair tonic and curling fluid dispensing bomb comprising two rings pivotally connected together with a hinge pin, and a coil spring engaged between the two rings for biasing the rings toward each other and for clasping or holding the hair or for styling the hair of the user.

However, the hair of the user may have a good chance to be entangled by or with the pivotal connection between the two rings and with the torsional spring or the coil spring. In addition, it will be difficult for the users or workers to assemble the rings and the hinge pin together.

U.S. Pat. No. 5,988,184 to Shu discloses another typical hair clip or hair styling device comprising two clasp plates hinged together with a pivot shaft, and a coil spring is also required to be provided and engaged between the two clasp plates for biasing the clasp plates toward each other and for clasping or holding the hair or for styling the hair of the user.

However, similarly, it also may have a good chance for the hair of the user to be entangled by or with the pivot shaft and/or with the pivotal connection between the two clasp plates and with the torsional spring or the coil spring. In addition, it will be difficult for the users or workers to assemble the clasp plates and the pivot shaft and the coil spring together.

The present invention has arisen to mitigate and/or obviate the afore-described disadvantages of the conventional hair clips or hair styling devices.

SUMMARY OF THE INVENTION

The primary objective of the present invention is to provide a hair clip including two spring-biased jaws resiliently coupled together with a resilient coupling device without a torsional spring or a coil spring for preventing the hair of the user from being entangled by the jaws and the torsional spring or the coil spring.

The other objective of the present invention is to provide a hair clip including two spring-biased jaws and a coupling device that may be easily and quickly coupled or assembled together without tools.

In accordance with one aspect of the invention, there is provided a hair clip comprising two jaws each including a first end and a second end, and a hand grip extended from the second end of each of the jaws, and a connector provided on a middle portion thereof, and a coupling device including a spring member having two end lugs engaged with the connectors of the jaws for easily and quickly and detachably and resiliently attaching or coupling the jaws and the coupling device together, and for applying a spring biasing force to bias and force the lugs and the first ends of the jaws toward each other, and for allowing the first ends of the jaws to be forced away from each other and to engage with a hair of a user when the hand grips are forced and depressed toward each other by the user, and for allowing the jaws and the coupling device to be easily and quickly and readily and detachably coupled or assembled together without torsional springs and tools without specially trained or skilled persons.

The jaws each include an opening formed therein for receiving and engaging with the spring member and for anchoring and securing the spring member to the jaws. The connectors of the jaws each include a flange extended from each arm for partially closing the space of the connector.

The connectors of the jaws each include two arms extended away from the jaws and spaced from each other for forming a space between the arms and for receiving and engaging with the lugs of the spring member.

The lugs of the spring member each include two opposite grooves formed therein for receiving and engaging with the flanges and for quickly and detachably attaching and securing the lugs to the connectors respectively.

The lugs of the spring member each include a stop formed in one end portion of the groove for engaging with the flanges and for limiting the lugs to slide relative to the connectors and for preventing the lugs from being disengaged from the connectors inadvertently.

The lugs of the spring member each include two opposite ribs for engaging with the spaces of the connectors and for anchoring and securing the lugs of the spring member to the connectors of the jaws.

The jaws each include at least one tooth formed in the first end for engaging with the hair of the user. The spring member preferably includes a C-shaped spring member which may be made of metal, plastic, rubber, soft, resilient or other elastic or synthetic materials.

An elastic member may further be provided and engaged with the lugs of the spring member for resiliently coupling the lugs of the spring member together and for applying a spring biasing force to bias and force the lugs and the first ends of the jaws toward each other.

The spring member includes a notch formed in each of the lugs for forming two limbs, and a bar extended through the notch of each lug and extended between the limbs for engaging with the elastic member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
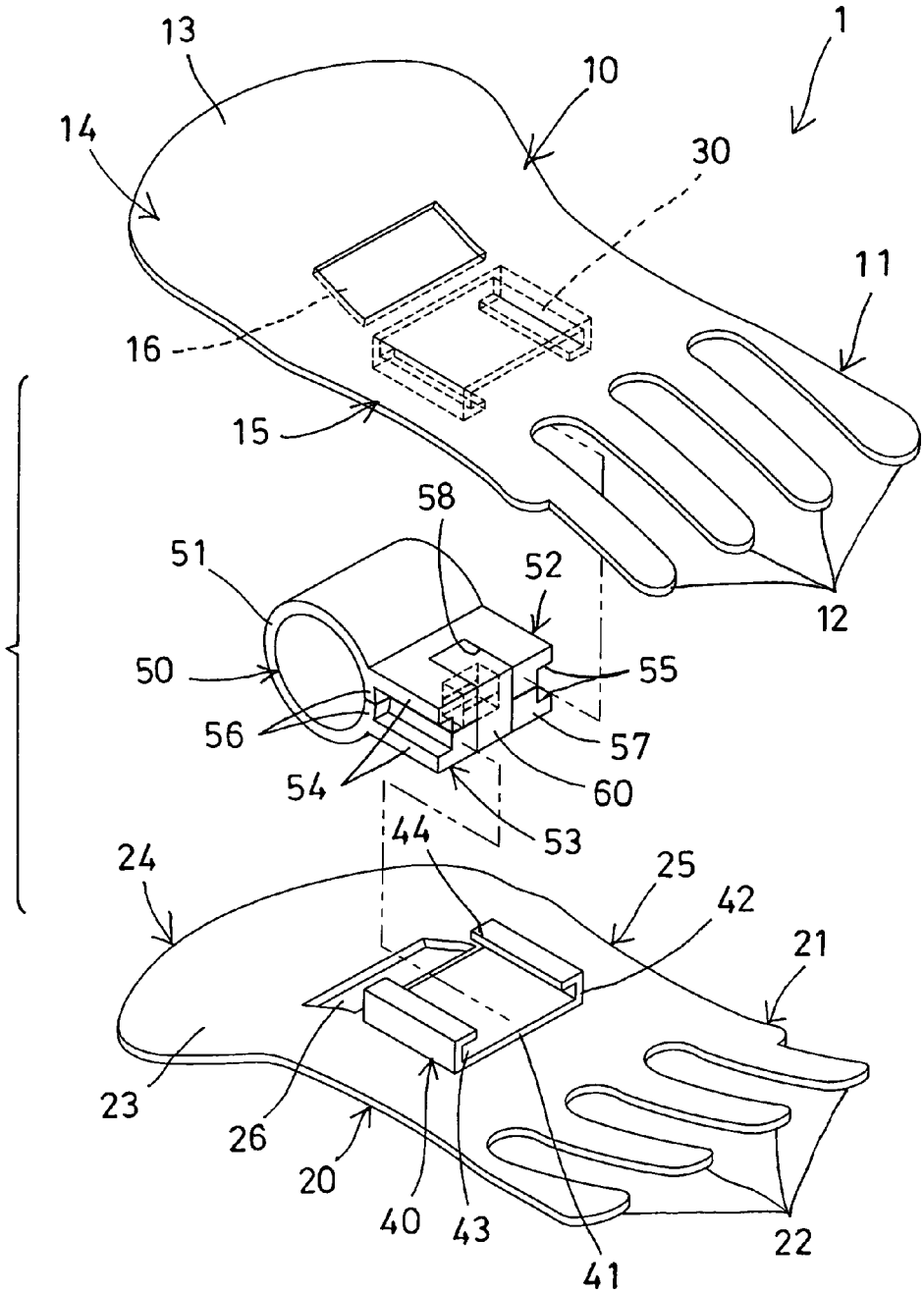
FIG. 1 is a partial exploded view of a hair clip in accordance with the present invention.
Figure 2:
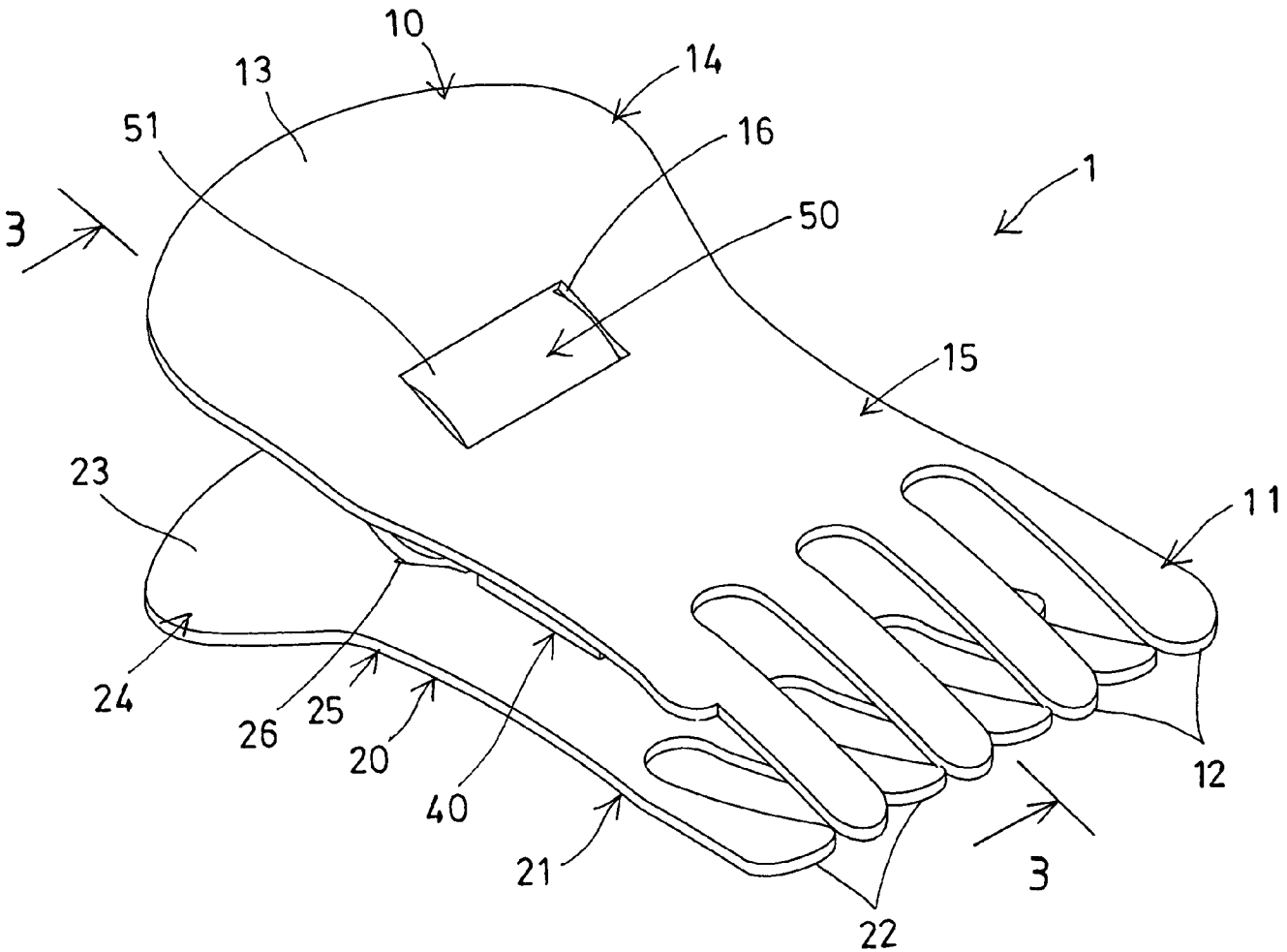
FIG. 2 is a perspective view of the hair clip.
Figure 3:
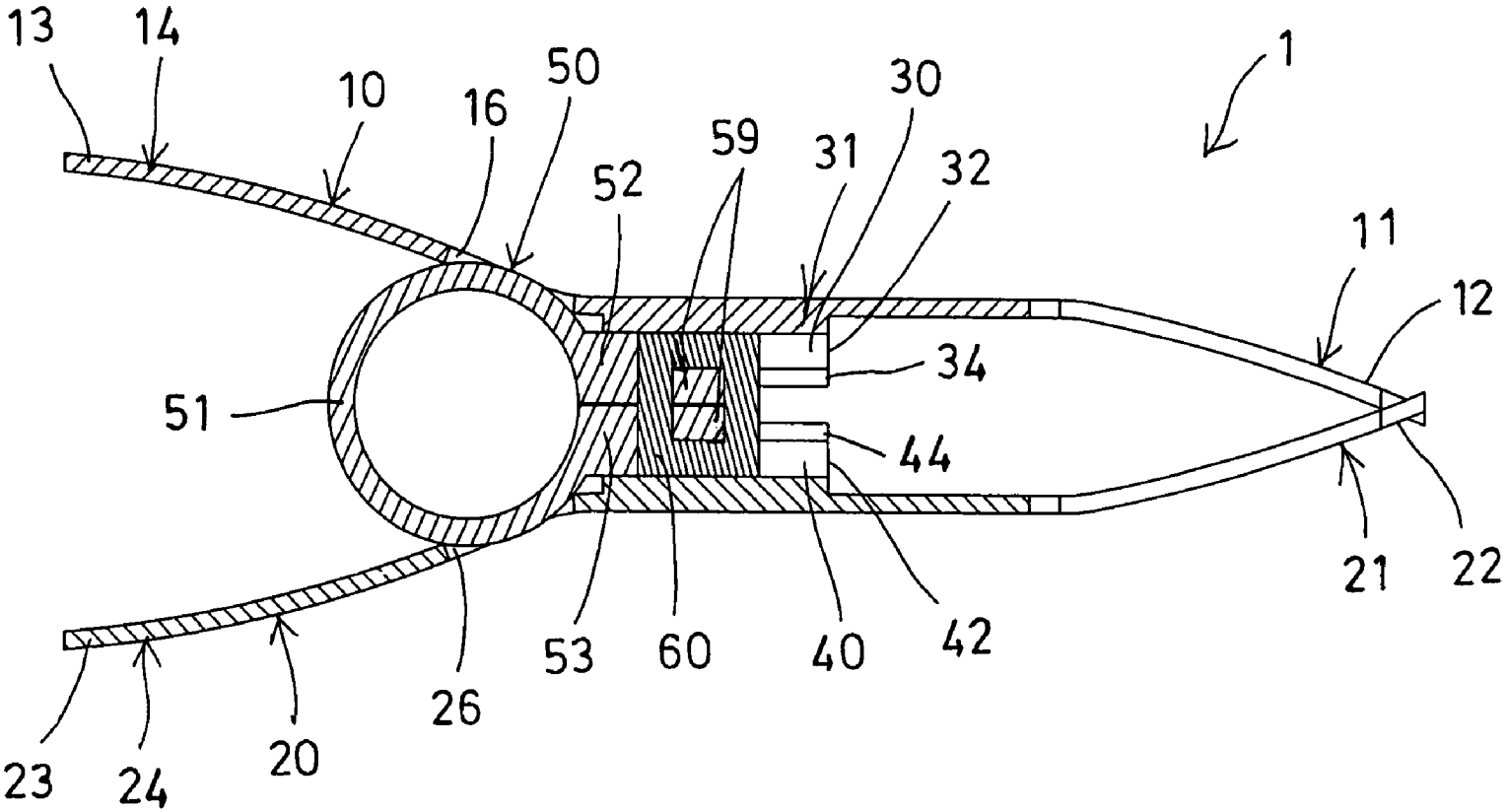
FIG. 3 is a cross sectional view of the hair clip, taken along lines 3-3 of FIG. 2.
Figure 4:
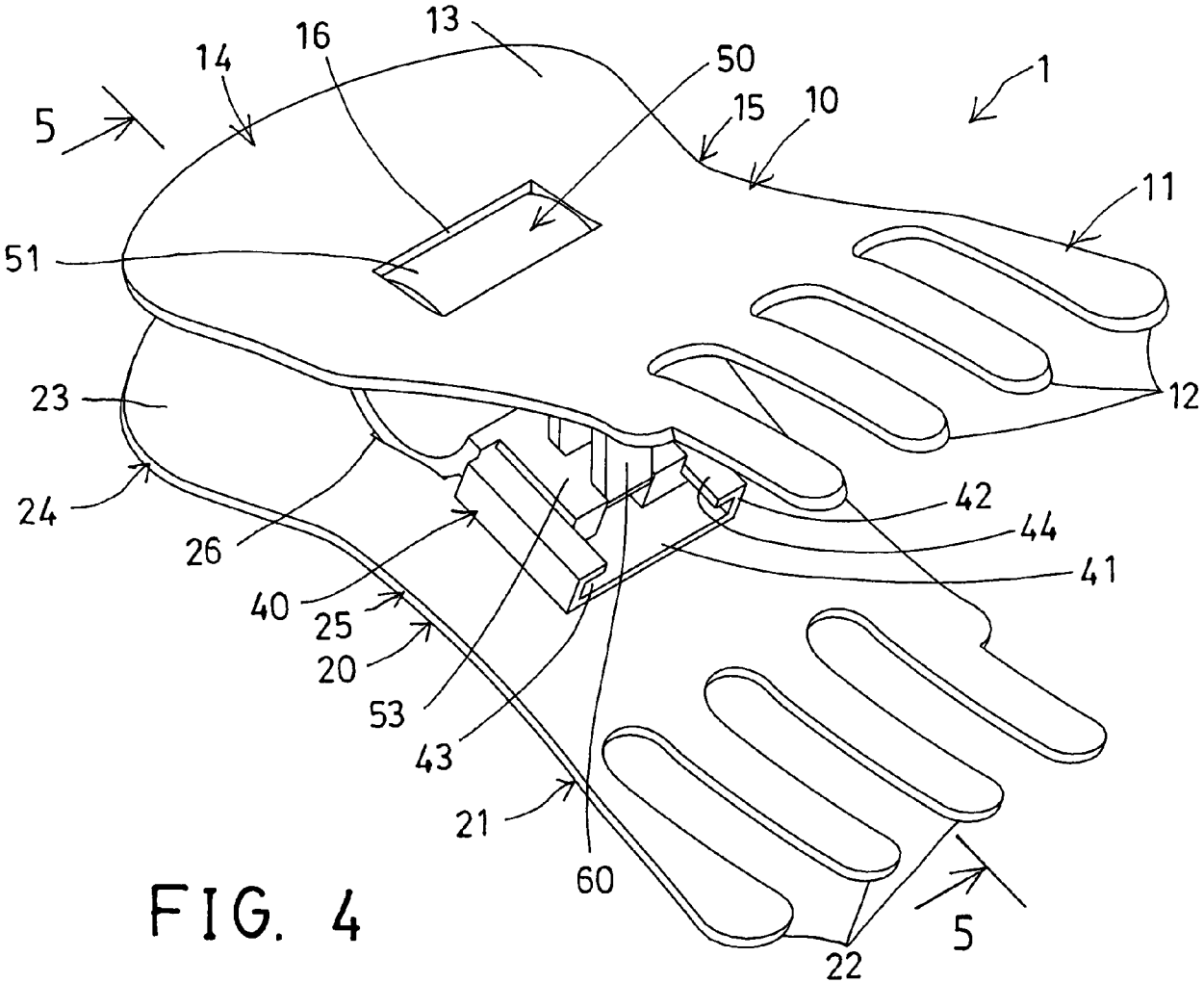
FIG. 4 is a perspective view similar to FIG. 2, illustrating the operation of the hair clip.
Figure 5:
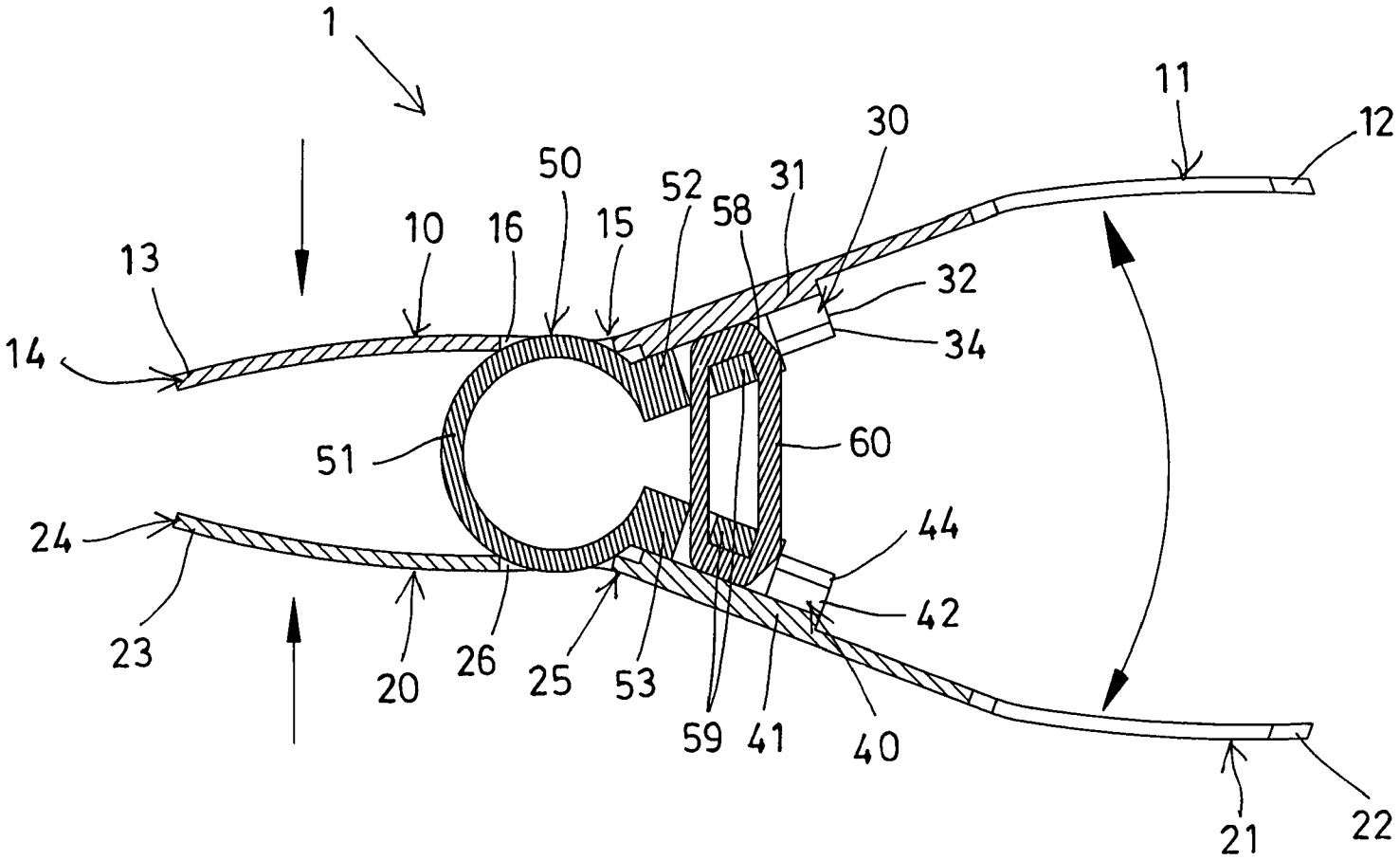
FIG. 5 is a cross sectional view of the hair clip, taken along lines 5-5 of FIG. 4.

Referring to the drawings, and initially to FIGS. 1-4, a hair clip 1 in accordance with the present invention comprises two jaws 10, 20 resiliently and pivotally connected or coupled together with a resilient coupling device 50 without a torsional spring or a coil spring for preventing the hair of the user from being entangled by the jaws 10, 20 and the torsional spring or the coil spring. The jaws 10, 20 each include one end portion 11, 21 having a number of teeth 12, 22 formed in the end portion 11, 21 for engaging with the hair of the user and for styling the hair of the user, and each include a hand grip 13, 23 formed integral with the jaws 10, 20 and extended from the other end portion 14, 24 of the jaws 10, 20 and inclined relative to the jaws 10, 20, best shown in FIGS. 3 and 4.

Figure 7:
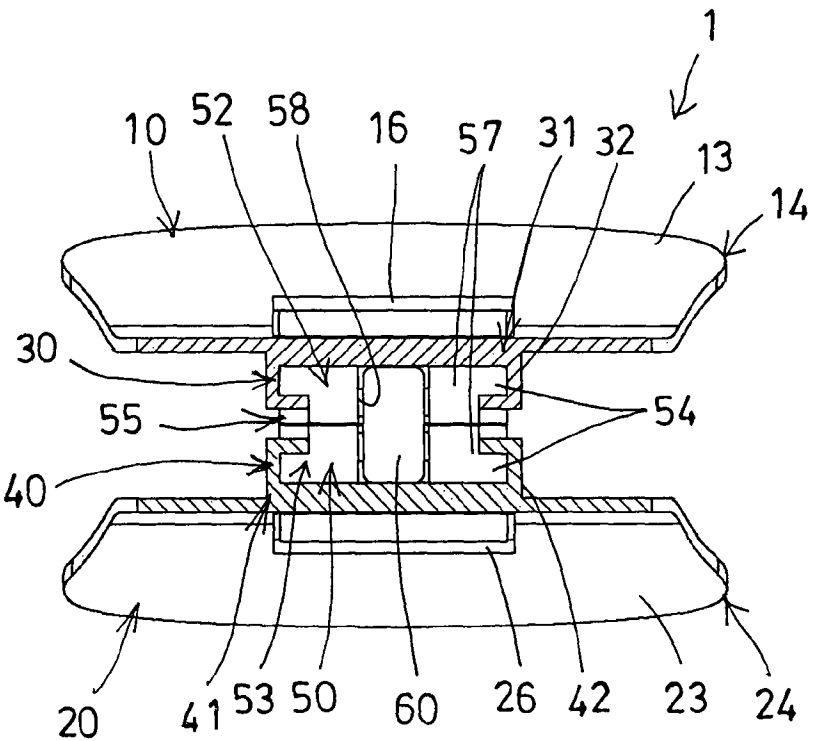
FIG. 7 is a cross sectional view of the hair clip, taken along lines 7-7 of FIG. 6.
Figure 6:
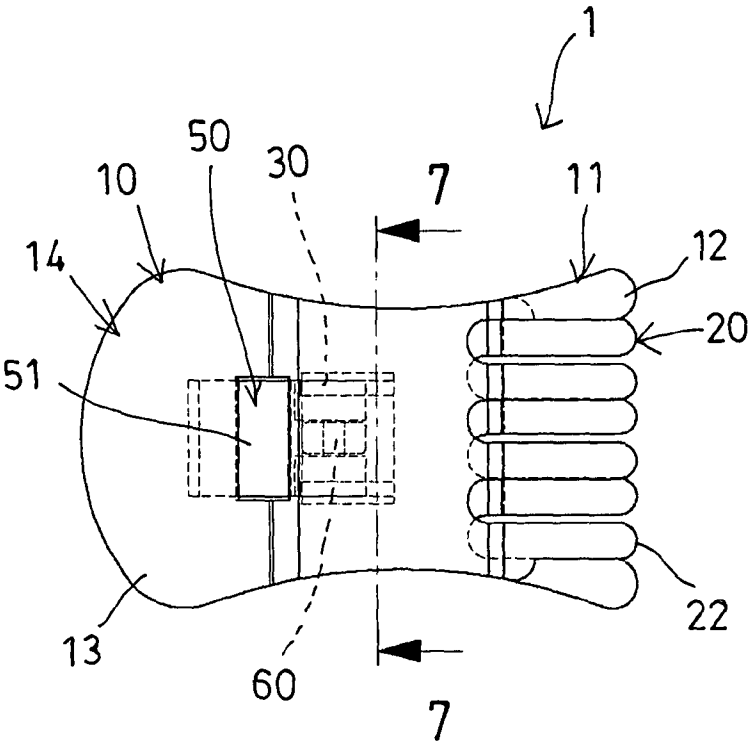
FIG. 6 is a top plan schematic view of the hair clip.

The jaws 10, 20 each include a middle portion 15, 25 having an opening 16, 26 formed therein located closer to the hand grips 13, 23, and each include a substantially U or C-shaped attachment or connector 30, 40 formed or provided thereon, or formed on the middle portion 15, 25 thereof respectively located closer to the teeth 12, 22 for quickly and detachably attaching or securing the resilient coupling device 50 to the jaws 10, 20. For example, the connectors 30, 40 each include a base plate 31, 41, and two arms 32, 42 extended from the base plate 31, 41 and extended away from the respective jaws 10, 20, or perpendicular to the respective jaws 10, 20, and spaced from each other for forming a space 33, 43 between the arms 32, 42, and an inwardly folded hook or flange 34, 44 extended from each arm 32, 42 for partially closing the space 33, 43 and for forming a U or C-shaped locking or retaining space 33, 43 in each of the connectors 30, 40 (FIGS. 1, 7).

The coupling device 50 includes a O or C-shaped or curved and intermediate clamping ring or spring blade or member 51, and two ends or brackets or lugs 52, 53 formed or provided on the ends of the ring or spring member 51 for engaging with the connectors 30, 40 of the jaws 10, 20 and for quickly and detachably attaching or securing or coupling the coupling device 50 to the jaws 10, 20, and/or for coupling the jaws 10, 20 and the coupling device 50 together. The O or C-shaped spring member 51 and the coupling device 50 may be made of metal, plastic, rubber or other resilient materials for applying a spring biasing force to the jaws 10, 20 and for biasing the teeth 12, 22 of the jaws 10, 20 toward each other, and the O or C-shaped spring member 51 may be engaged with the opening 16, 26 of the jaws 10, 20 for anchoring or securing or locking the O or C-shaped spring member 51 and the coupling device 50 to the jaws 10, 20.

The lugs 52, 53 of the coupling device 50 each include a substantially T-shaped or dovetail-shaped structure having two opposite ribs 54 for engaging with the spaces 33, 43 of the connectors 30, 40, and two opposite grooves 55 for receiving or for engaging with the flanges 34, 44 respectively and for quickly and detachably attaching or securing the lugs 52, 53 to the connectors 30, 40 respectively. It is preferable that the lugs 52, 53 of the coupling device 50 each include a stop 56 formed in one end portion thereof and extended into one end portion of the groove 55 for engaging with the flanges 34, 44 and for limiting the lugs 52, 53 to slide relative to the connectors 30, 40 respectively, and for preventing the lugs 52, 53 from being disengaged from the connectors 30, 40 inadvertently.

The lugs 52, 53 of the coupling device 50 each further include a gap or groove or slot or notch 58 formed therein, such as formed in the middle portion thereof (FIGS. 1, 7) for forming two limbs 57, and a bar 59 extended through the notch 58 of each lug 52, 53 and extended or straddled between the limbs 57, for selectively engaging with a rubber or resiliently strap or elastic member 60, in which the elastic member 60 may, in addition, be provided and engaged with or in the notches 58 of the lugs 52, 53 and engaged with the bars 59 of the lugs 52, 53 for resiliently coupling the lugs 52, 53 together and for applying a spring biasing force to bias and force the lugs 52, 53 and thus the teeth 12, 22 of the jaws 10, 20 toward each other.

In operation, as shown in FIGS. 2-5, the hand grips 13, 23 may be forced or depressed toward each other by the user to force the end portions 11, 21 and the teeth 12, 22 of the jaws 10, 20 away from each other (FIGS. 4, 5) and to allow the hair of the user to be easily and quickly engaged with the jaws 10, 20 and to allow the hair of the user to be solidly and resiliently retained in the jaws 10, 20. It is to be noted that no torsional springs or coil springs are provided and attached or engaged into the hair clip 1 such that the hair of the user will not be entangled by the torsional springs or the coil springs. The jaws 10, 20 and the hand grips 13, 23 and the coupling device 50 may be made of metal, plastic, rubber, or other synthetic materials.

Accordingly, the hair clip in accordance with the present invention includes two spring-biased jaws resiliently coupled together with a resilient coupling device without a torsional spring or a coil spring for preventing the hair of the user from being entangled by the jaws and the torsional spring or the coil spring, and for allowing the jaws and the coupling device to be easily and quickly coupled or assembled together without torsional springs and tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hair clip comprising:

two jaws each including a first end and a second end, and a hand grip extended from said second end of each of said jaws, and a connector provided on a middle portion thereof, and said connectors of said jaws each including two arms extended away from said jaws and spaced from each other for forming a space between said arms, and said connectors of said jaws each including a flange extended from each arm for partially closing said space of said connector, and a coupling device including a spring member having two end lugs engaged with said space which is formed between said arms of said connectors of said jaws for resiliently coupling said jaws and said coupling device together, and for applying a spring biasing force to bias and force said lugs and said first ends of said jaws toward each other, and for allowing said first ends of said jaws to be forced away from each other and to engage with a hair of a user when said hand grips are forced and depressed toward each other by the user.

2. The hair clip as claimed in claim 1, wherein said jaws each include an opening formed therein for receiving and engaging with said spring member and for anchoring and securing said spring member to said jaws.

3. The hair clip as claimed in claim 1, wherein said lugs of said spring member each include two opposite grooves formed therein for receiving and engaging with said flanges and for quickly and detachably attaching and securing said lugs to said connectors respectively.

4. The hair clip as claimed in claim 3, wherein said lugs of said spring member each include a stop formed in one end portion of said groove for engaging with said flanges and for limiting said lugs to slide relative to said connectors.

5. The hair clip as claimed in claim 1, wherein said lugs of said spring member each include two opposite ribs for engaging with said spaces of said connectors and for anchoring and securing said lugs of said spring member to said connectors of said jaws.

6. The hair clip as claimed in claim 1, wherein said jaws each include at least one tooth formed in said first end for engaging with the hair of the user.

7. The hair clip as claimed in claim 1, wherein said spring member is a C-shaped spring member.

8. A hair clip comprising:

two jaws each including a first end and a second end, and a hand grip extended from said second end of each of said jaws, and a connector provided on a middle portion thereof, a coupling device including a spring member having two end lugs engaged with said connectors of said jaws for resiliently coupling said jaws and said coupling device together, and for applying a spring biasing force to bias and force said lugs and said first ends of said jaws toward each other, and for allowing said first ends of said jaws to be forced away from each other and to engage with a hair of a user when said hand grips are forced and depressed toward each other by the user, and an elastic member provided and engaged with said lugs of said spring member for resiliently coupling said lugs of said spring member together and for applying a spring biasing force to bias and force said lugs of said spring member and said first ends of said jaws toward each other.

9. The hair clip as claimed in claim 8, wherein said spring member includes a notch formed in each of said lugs for forming two limbs in each lug, and a bar extended through said notch of each lug and extended between said limbs for engaging with said elastic member.

* * * * *